US006044704A

United States Patent [19]

Sacher

[11] Patent Number: 6,044,704

[45] Date of Patent: Apr. 4, 2000

[54] FOLLOW-THROUGH MEASURING DEVICE

[76] Inventor: David Sacher, 612 S. Cochnan Ave., Los Angeles, Calif. 90036

[21] Appl. No.: 08/999,464

[22] Filed: Dec. 29, 1997

[51] Int. Cl.[7] ..... A61B 5/22

[52] U.S. Cl. ..... 73/379.04

[58] Field of Search ..... 73/379.04, 490, 73/862.041, 862.628; 473/223; 702/158

[56] References Cited

U.S. PATENT DOCUMENTS

| | | | |
|---|---|---|---|
| D. 305,922 | 2/1990 | Mercado | D21/212 |
| 4,088,324 | 5/1978 | Farmer | 273/186 A |
| 4,759,219 | 7/1988 | Cobb et al. | 73/493 |
| 4,940,236 | 7/1990 | Allen | 273/183 D |
| 5,031,909 | 7/1991 | Pecker | 273/29 A |
| 5,056,783 | 10/1991 | Matcovich et al. | 273/26 R |
| 5,209,483 | 5/1993 | Gedney et al. | 273/187 |
| 5,324,029 | 6/1994 | Kim | 273/67 |
| 5,439,217 | 8/1995 | Ganger, Sr. | 273/75 |
| 5,571,972 | 11/1996 | Okada | 73/862.043 |
| 5,709,610 | 1/1998 | Ognjanovic | 473/223 |

*Primary Examiner*—Benjamin R. Fuller
*Assistant Examiner*—Jewel V. Thompson
*Attorney, Agent, or Firm*—Goldstein & Canino

[57] ABSTRACT

A follow-through measuring device for measuring and displaying the time duration of impact comprises a piezoelectric sensor for sensing the presence of force while the athletic implement is in contact with a ball. The sensor provides a signals with a time duration equal to the time of contact of the ball with the striking implement. The follow-through measuring device further comprises a display unit which houses a receiver, a timer circuit, and a clock display. The signal provided by the sensor is transmitted to the receiver in the display unit, via an rf signal. The timer circuit measures the duration of time which the signal exceed a predetermined trigger level. The display unit then displays the measured time on the clock display.

4 Claims, 3 Drawing Sheets

FOLLOW-THROUGH MEASURING DEVICE

BACKGROUND OF THE INVENTION

This invention relates to a follow-through measuring device. More particularly, the invention relates to a device which measures the length of time a tennis racquet, baseball bat or golf club is in contact with a ball, and displays the measured time.

Many sports, such as tennis, baseball, and golf, use equipment that is swung by the individual players to strike a ball. The act of continuing the swing of a tennis racquet, baseball bat, or golf club to its natural end after striking the ball, also commonly referred to as follow-through, when properly executed, significantly enhances the performance of the game. The longer the time period of impact between the ball and the striking instrument, the greater the exiting ball velocity and the greater the distance the ball travels. Especially in the game of tennis, the ability to consistently execute proper follow-through not only increases the power with which the ball is hit but also increases one's ability to control the ball.

Thus, it is desirable to have a device that can indicate whether a proper follow-through has been executed by measuring the length of time the ball is in contact with the hitting instrument and visually displaying the measured time. If players have an ability to monitor their swing, they can quickly adjust their swinging technique which will produce a superior swing with a proper follow-through.

While various references uncovered in the prior art provide devices that utilize transducers to compute ball distance, no device measures and displays the time duration of impact between a ball and a swinging implement. For example, U.S. Pat. No. 4,088,324 to Farmer discloses an athletic implement with visual range display which employs an accelerometer mounted in the golf club head to compute ball distance. U.S. Pat. No. 4,940,236 to Allen discloses another device which computes ball distance by utilizing a molecularly polarized piezoelectric plastic film composite mounted in the golf club head.

Likewise, U.S. Pat. No. 5,209,483 to Gedney discloses yet another device which computes ball distance by utilizing an array of polyvinylidene fluoride film sensor elements mounted in the golf club head. U.S. Pat. No. 5,506,783 to Matcovich discloses a baseball bat having an accelerometer to determine whether the impact between a baseball bat and a baseball occurred before, after, or exactly at the time of maximum velocity.

While these units mentioned above may be suitable for the particular purpose employed, or for general use, they would not be as suitable for the purposes of the present invention as disclosed hereafter.

SUMMARY OF THE INVENTION

It is an object of the invention to provide a follow-through measuring device which is capable of measuring a time period beginning when the tennis racquet, baseball bat or golf club strikes the ball and ending when the ball is no longer in contact therewith.

It is another object of the invention to provide a follow-through measuring device which presents instant feedback on whether a swing accomplished the proper follow-through by displaying the measured duration of impact between the ball and the striking implement on a display unit.

It is yet another object of the invention to provide a tennis racquet and a display unit having a follow-through measuring and displaying capability and which can be utilized for practice purposes as well as for actual play of the tennis game.

It is a further object of the invention to provide a follow-through measuring device which can be readily incorporated into existing tennis racquets.

The invention is a follow-through measuring device for measuring and displaying the time duration of impact, comprising a piezoelectric sensor for sensing the presence of force while the athletic implement is in contact with a ball. The sensor provides a signals with a time duration equal to the time of contact of the ball with the striking implement. The follow-through measuring device further comprises a display unit which houses a receiver, a timer circuit, and a clock display. The signal provided by the sensor is transmitted to the receiver in the display unit, via an rf signal. The timer circuit measures the duration of time which the signal exceed a predetermined trigger level. The display unit then displays the measured time on the clock display.

To the accomplishment of the above, and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 4:
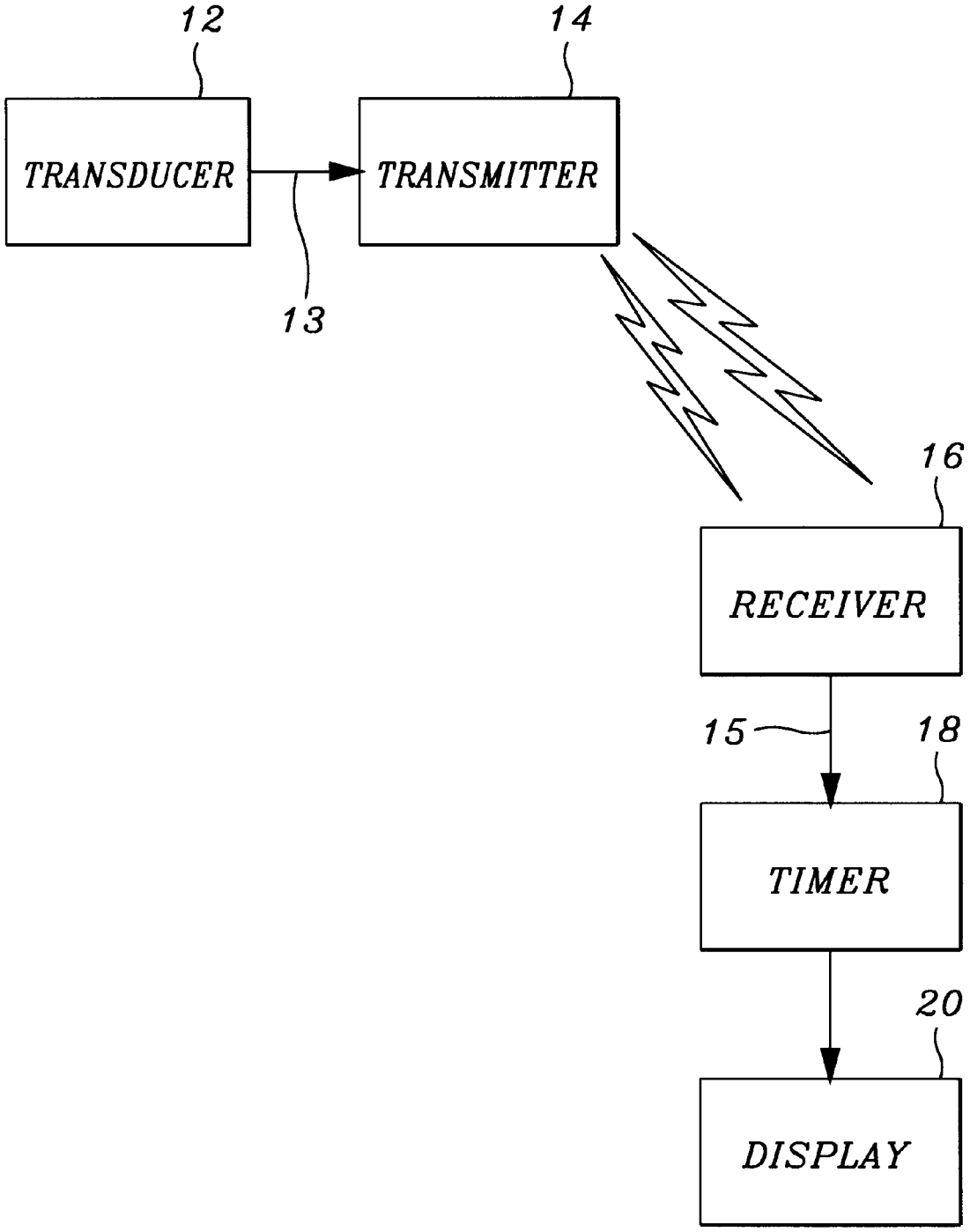
FIG. 4 is a block diagram of the instant invention.

FIG. 4 schematically illustrates a follow-through measuring device for use in an athletic implement such as a tennis racquet, a golf club, or a baseball bat. A transducer 12 senses the presence of force while the athletic implement is in contact with a ball and produces a transducer output signal 13 representing the impact force and the duration of impact. A transmitter 14 is connected to the transducer 12, whereby the output signal from the transducer 12 is transmitted to a receiver 16 via an rf signal. The receiver 16 produces a receiver output 15 while it detects the rf signal. The receiver output 15 is connected to a timer 18 for measuring the length of time the signal from the receiver 16 exceeds a predetermined trigger level. A display 20 is connected to the timer 18 for displaying the measured time.

Figure 1:
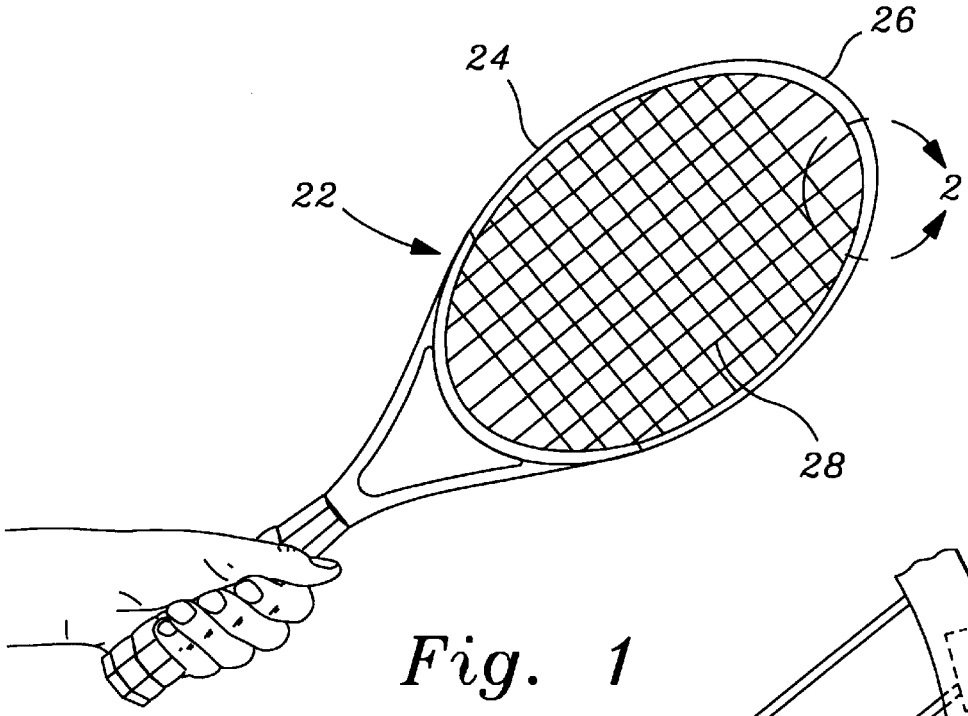
FIG. 1 is a diagrammatic perspective view of a tennis racquet incorporating the principles of a preferred embodiment of the instant invention.
Figure 2:
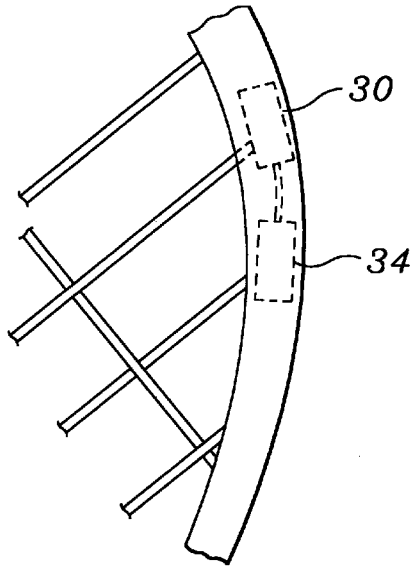
FIG. 2 is an enlarged perspective view of the area indicated in circle 2 in FIG. 1.

FIGS. 1 and 2 illustrate a tennis racquet 22 having a frame 24, an upper surface 26, and a plurality of strings 28 attached to the frame 24. The follow-through measuring device includes a piezoelectric sensor 30 mounted on the frame of the tennis racquet 22 for sensing the presence of force during the time period the tennis racquet 22 is in contact with a tennis ball. When the tennis racquet 22 strikes a ball, one of the strings 28 on the tennis racquet 22 become tighter and maintains that tightness until the ball is no longer in contact with the string 28, causing a pressure to be applied on the piezoelectric sensor 30 by the pulling force of that string 28. Whereupon the piezoelectric sensor 30 produces an analog voltage output signals representing the compression force exerted by the string 28 on the sensor 30 during the time of impact between the ball and the racquet 22.

Figure 5:
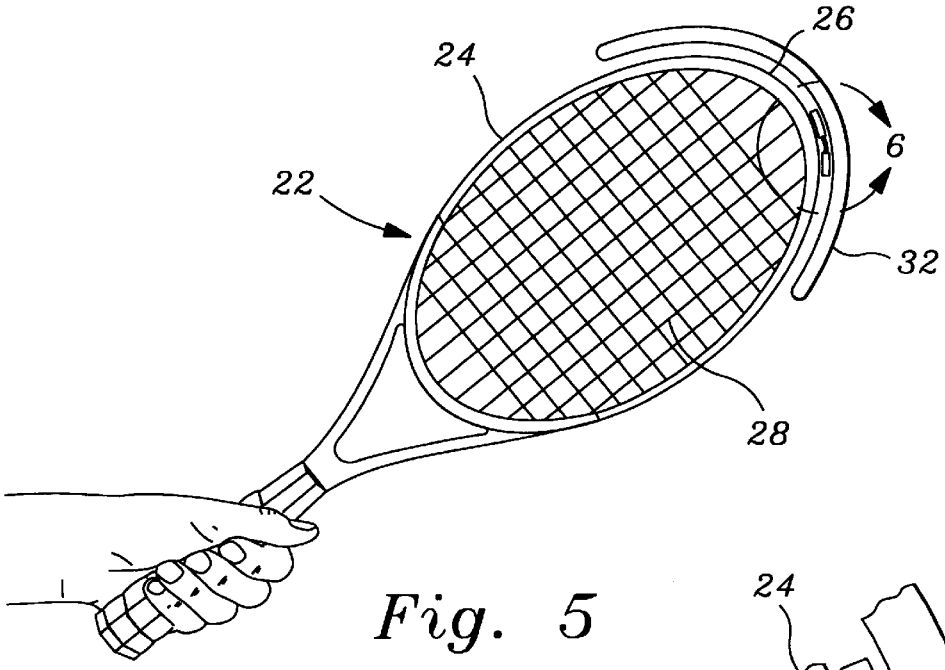
FIG. 5 is an exploded view of a tennis racquet incorporating the principles of an alternative embodiment of the instant invention.
Figure 6:
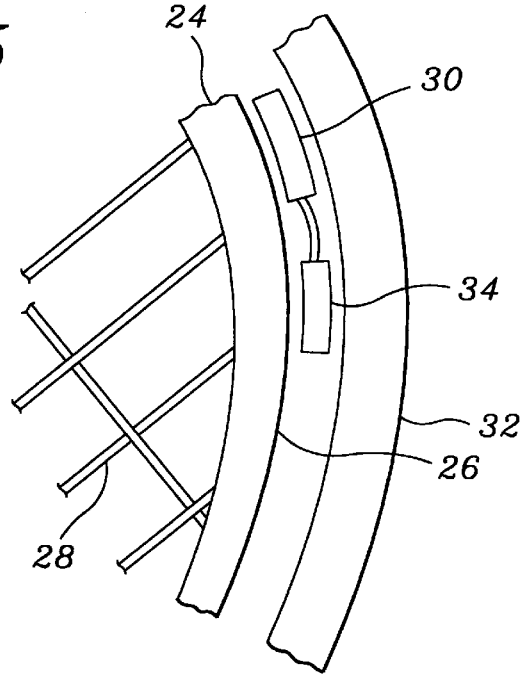
FIG. 6 is an enlarged exploded view of the area indicated in circle 6 in FIG. 5.

Referring to FIGS. 5 and 6, in an alternative embodiment, the piezoelectric sensor 30 is sandwiched between the upper surface 26 of the frame 24 and a scratch guard 32. Nowadays, many tennis racquets are provided with a scratch guard 32 to protect the frame 24. The size and shape of the piezoelectric sensor 30 is adapted to fit between the upper surface 26 of the frame 24 and the scratch guard 32 without obstructing the string holes. While the tennis racquet 22 is in contact with the ball, the string 28 tightens and pulls the scratch guard 32 toward the frame 24, thereby compressing the sensor 30 against the frame 24. In this way the piezoelectric sensor 30 provides a signal with a time duration equal to the time of contact of the ball with the string 28 of the racquet 22.

Alternatively, the sensor 30 may be attached directly on the scratch guard 32 during manufacturing. The scratch guard 32 is then placed over the upper surface 26 of the frame 24 and is secured to the racquet 22 by attaching the string 28 to the racquet 22. This assures that there will be no relative movement between the scratch guard 26, the frame 24, and the sensor 30.

FIGS. 2 and 6 illustrate a transmitter 34 mounted on the frame 24 of the tennis racquet 22 and is electrically connected to a portable power source and the sensor 30 such that the voltage output from the sensor 30 is transmitted to a receiver via an rf signal. A simple mechanical switch may be added to disconnect the portable power source when not in use.

Figure 3:
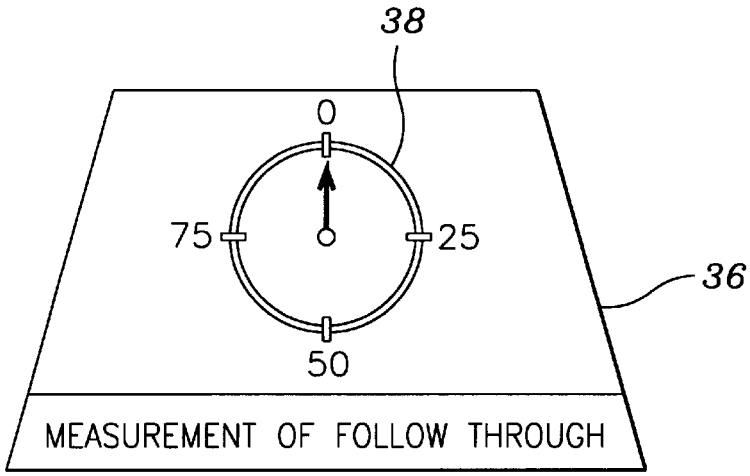
FIG. 3 is a front elevational view of the display unit of the instant invention.

FIG. 3 illustrate a display unit 36 of the present invention which houses a receiver, a timer circuit, and a clock display 38. In use, the display unit 36 is placed on the tennis court where it can be easily seen by the user. The receiver within the display unit 36 is utilized to receive the rf signal transmitted by the transmitter 34 in the tennis racquet 22. The rf signal received are fed into the timer circuit. The timer circuit monitors the magnitude of the signal from the receiver and measures the length of time the signal exceed a predetermined trigger level until the signal falls below the trigger lever.

The measured time from the timer circuit is displayed on the clock display 38 to provide the user with instant feedback of his or her swing performance in a familiar form. There might be additional electric circuitry necessary to drive the clock display 38. These components are well known to persons of ordinary skill in the art. The clock display 38 on the display unit 36 is preferably large enough so that the measured time can be read quickly and easily. Although FIG. 3 illustrates an analog clock display using a needle to graphical display the measured time, it should be noted that the clock display can be of any other suitable display device including LCD, LED, or CRT.

In operation, the tennis racquet 22 of the present invention is used by an individual player during a practice or actual game. By glancing at the display unit 36, the player can determine whether his or her swing accomplished the proper follow-through, that is whether the time of contact with the ball is maximized.

While the embodiments of the present invention are disclosed in relation of a tennis racquet, it will be appreciated by those skilled in the art that the follow-through measuring device disclosed herein may be utilized in connection with other athletic implements, such as golf clubs, baseball bats and the like.

Many specific details contained in the above description merely illustrate some preferred embodiments and should not be construed as a limitation on the scope of the invention. Many other variations are possible.

What is claimed is:

1. A follow-through measuring device for use with an athletic implement, for measuring time duration of contact between a ball and said athletic implement, comprising:

a) a compression force sensing means affixed to said implement for sensing a presence of force during the time period said implement is in contact with said ball and for producing output signals representing the compression force;

b) a transmitter connected to said compression force sensing means for transmitting said output signals;

c) a receiver remotely coupled to the transmitter for receiving the transmitted signal and producing a receiver output in response thereto;

d) a timer circuit means connected to the receiver for measuring the length of time the receiver output exceeds a predetermined trigger level and producing a measured time; and e) a display means connected to the timer circuit for displaying said measured time from said timer circuit.

2. A follow-through measuring device for use with a tennis racquet having a frame, an upper surface, and strings, for measuring time duration of contact between a ball and said tennis racquet, comprising:

a) a compression force sensing means mounted on said frame of the tennis racquet for sensing a presence of force during the time period said tennis racquet is in contact with said ball and for producing output signals representing the compression force exerted by said string on the said compression force sensing means;

b) a transmitter connected to said compression force sensing means for transmitting said output signals;

c) a receiver remotely coupled to the transmitter for receiving the transmitted signal and producing a receiver output in response thereto;

d) a timer circuit means connected to the receiver for measuring the length of time the receiver output exceeds a predetermined trigger level and producing a measured time; and e) a display means connected to the timer circuit for displaying said measured time from said timer circuit.

3. The follow-through measuring device of claim 2, wherein, the tennis racquet has a scratch guard, wherein the compression force sensing means is mounted between the upper surface of the tennis racquet and said scratch guard.

4. The follow-through measuring device of claim 3, wherein the compression force sensing means comprise a piezoelectric sensor responsive to a degree of pressure applied.

* * * * *